US006000898A

United States Patent [19]

Sharp

[11] Patent Number: 6,000,898

[45] Date of Patent: Dec. 14, 1999

[54] WALL LIFT AND METHOD OF LIFTING A WALL

[76] Inventor: Joseph W. Sharp, R.R. 1 Box 65A, Mifflinburg, Pa. 17844

[21] Appl. No.: 09/240,782

[22] Filed: Jan. 29, 1999

Related U.S. Application Data

[60] Provisional application No. 60/076,444, Mar. 2, 1998.

[51] Int. Cl.[6] ..... E04G 21/14

[52] U.S. Cl. ..... 414/11; 414/800

[58] Field of Search ..... 414/10, 11, 800

[56] References Cited

U.S. PATENT DOCUMENTS

| | | | |
|---|---|---|---|
| 2,812,077 | 11/1957 | Proctor . | |
| 2,907,477 | 10/1959 | Coleman . | |
| 3,485,386 | 12/1969 | Miller | 414/11 |
| 4,133,097 | 1/1979 | Slade . | |
| 4,481,743 | 11/1984 | Jellen . | |
| 4,718,564 | 1/1988 | Bailey | 414/11 |
| 4,986,043 | 1/1991 | Love . | |
| 5,322,404 | 6/1994 | Keller . | |
| 5,445,487 | 8/1995 | Koscinski, Jr. . | |
| 5,630,696 | 5/1997 | Gordon . | |
| 5,634,301 | 6/1997 | Koller . | |
| 5,833,430 | 11/1998 | Reynolds et al. | 414/11 |

*Primary Examiner*—James W. Keenan
*Assistant Examiner*—Gregory A. Morse
*Attorney, Agent, or Firm*—John J. Elnitski, Jr.

[57] ABSTRACT

The present invention is a wall lift which includes a base, lifting arm, wall attachment bracket and at least one safety strap as the main components. Each main component includes its own individual components which aid in the operation of the wall lift. The wall lift raises a prefabricated wall by lifting at a top of the wall so that the wall rotates about a bottom of the wall. The lifting arm is rotatably attached to the base. The lifting arm includes a motor and starts in a vertical position. The motor includes a cable attached to a wall movement unit. The wall movement unit attaches to the top of the wall and is also slidably attached to the lifting arm. The lifting arm rotates in the direction that the wall is being lifted as the motor retracts the cable. The cable pulls the wall movement unit towards a top of the lifting arm during retraction. The wall is lifted due to its attachment to the wall movement unit as the wall movement unit is pulled by the cable.

20 Claims, 16 Drawing Sheets

WALL LIFT AND METHOD OF LIFTING A WALL

This application claims the benefit of U.S. Provisional Application No.: 60/076,444 filed Mar. 2, 1998.

BACKGROUND

For the construction of buildings, especially housing, contractors employ the prefabrication of walls at the site. This includes the mounting of the first layer of exterior surface to the wall, which is usually plywood or particle board. The walls are built in a horizontal plane or flat position on a level surface. The level surface is usually the subfloor of the building to which the bottom of the wall will be mounted. This technique is employed due to the ease of assembling the components of the wall. The wall is maintained in a squared orientation due to the mounting of the exterior surface, which retains the position of all four corners of the wall. Once fabricated, the wall is lifted at the top of the wall and rotated about the bottom of the wall into an upright position on the subfloor by workmen on the job. The wall is then secured to the subfloor and any other walls as called for in the construction plans. The problem arises in that the walls are heavy due to length, addition of the exterior surface and any insulation between the wall and exterior surface. The increased weight requires more workmen then normally staffed by the contractor to lift the wall without risk of injury. The lack of staffing of workmen is due to the fact that there would be no work for the extra workmen except for the lifting of the walls. The contractor tends to incur costs for injury claims from workmen hurt during the lifting of walls. Most of the reported injuries are to the workmen's back, which can be quite costly to the contractor. Therefore, it would be advantageous for the contractor to remove the workmen from the physical labor of lifting walls, whenever possible.

There are various devices on the market to aid in the lifting of a wall during the erection of a building. Some of these devices employ some sort of power to lift the wall. The powered devices tend to be cumbersome to transport and setup. This adds to the cost of construction due to the additional time needed to transport and setup. The non-powered devices are simpler to use, but still require manual force by workmen to lift the wall. Therefore, the use of the non-powered device does not remove workmen from potential injury when lifting the wall. What is required in the construction industry is a wall lifting device which is easy to transport, easy to setup, simple to operate, and removes the workmen from physically lifting the wall.

It is an object of the present invention to provide a wall lift which removes workmen from physically lifting the wall.

It is an object of the present invention to provide a wall lift which is easy to transport, easy to setup and simple to operate.

SUMMARY OF THE INVENTION

The present invention is a wall lift for lifting a wall in an upright position. The wall lift includes a floor plate, a lifting arm, a motorized cable movement system, a cable and a wall movement unit. The bottom of the lifting arm is rotatably attached to the floor plate. The motorized cable movement system is attached to the lifting arm for retracting the cable. The wall movement unit is attached to a top of the wall. The wall movement unit is also attached to and slidable along the lifting arm. The cable is connected to the wall movement unit. The motorized cable movement system retracts the cable, thereby pulling the wall movement unit along the lifting arm. As the wall movement unit moves along the lifting arm, the wall is raised to an upright position.

DETAILED DESCRIPTION

Figure 1:
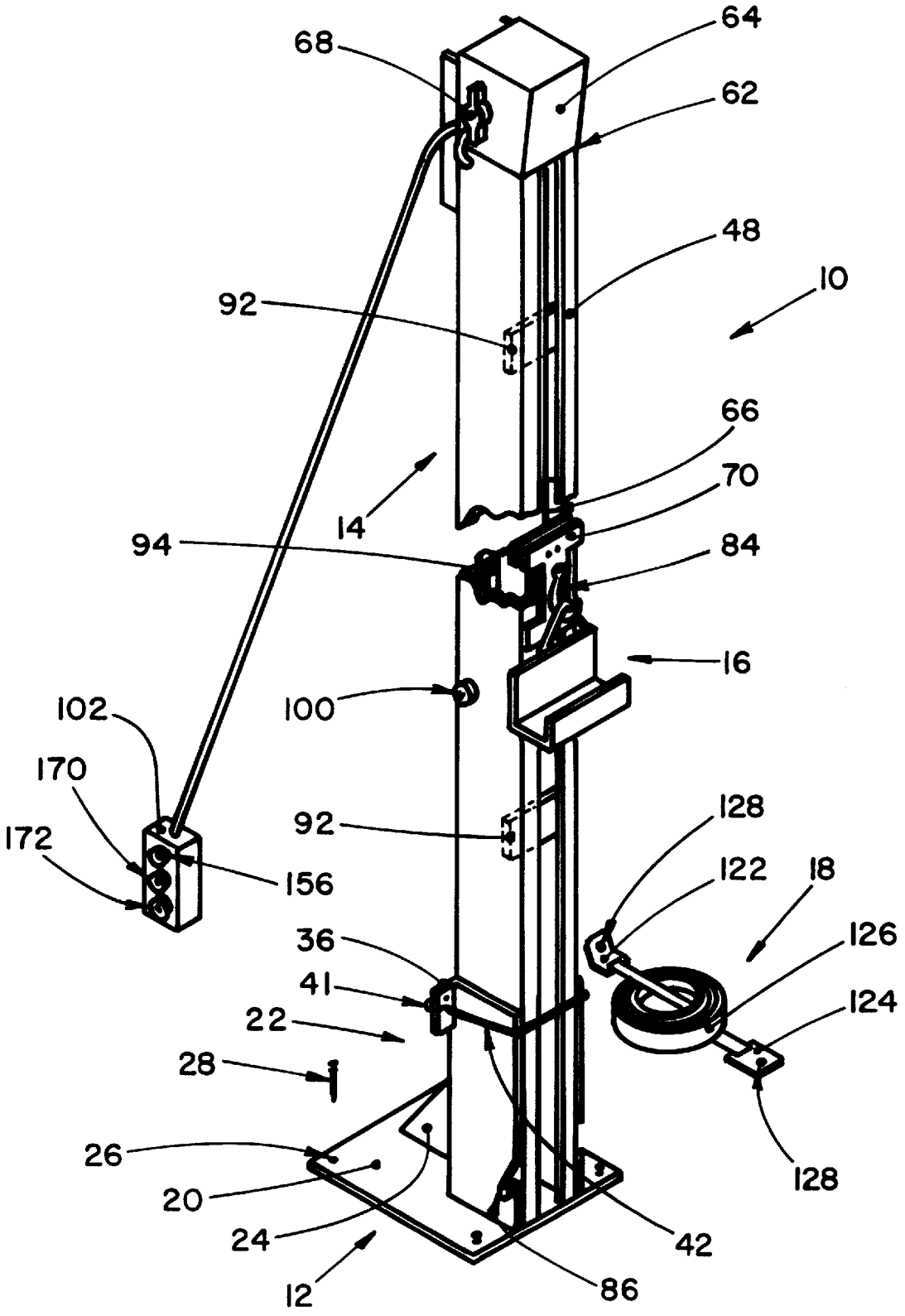
FIG. 1 is a perspective view of a wall lift according to the present invention.
Figure 2:
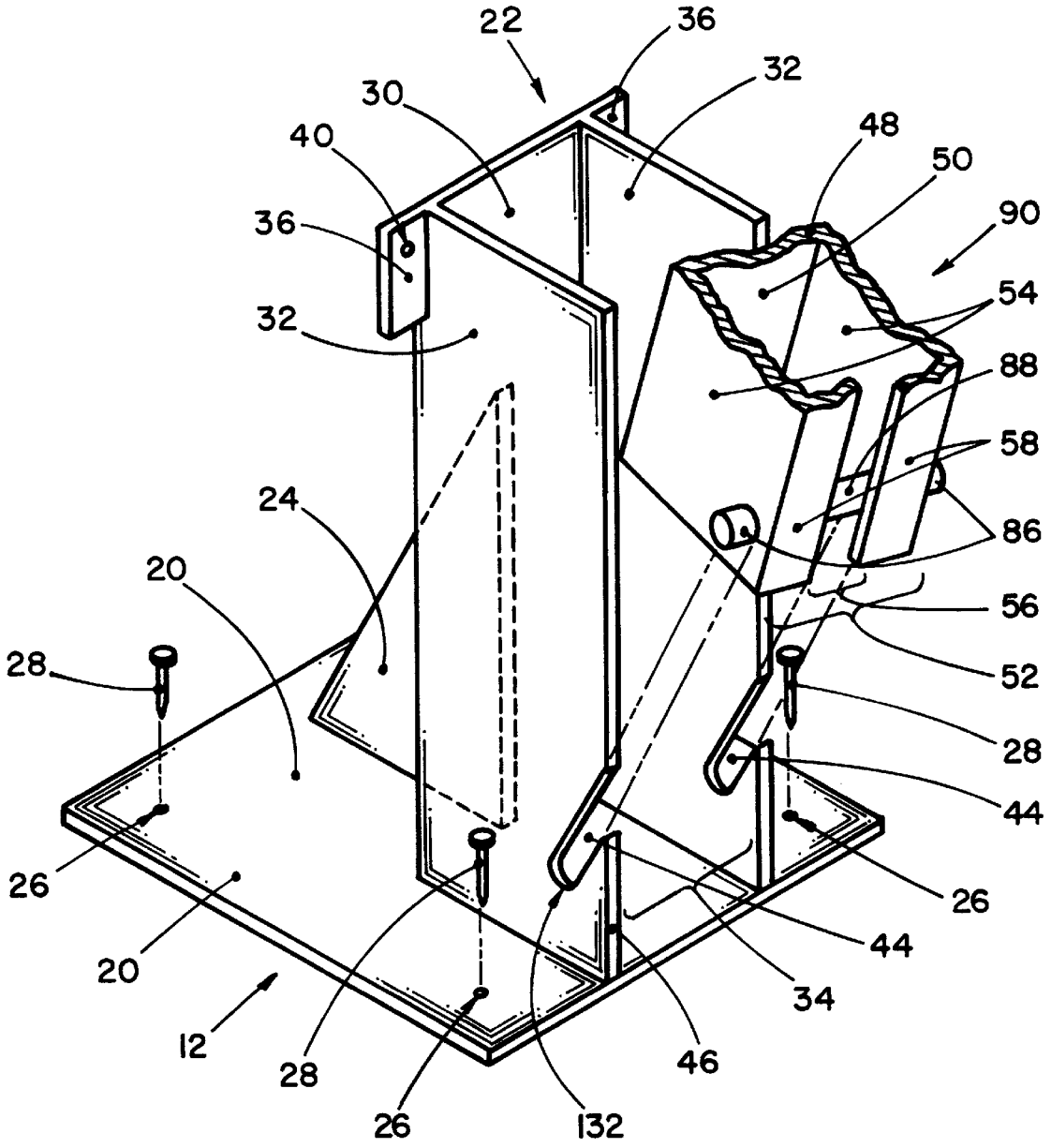
FIG. 2 is a perspective view of a base and cutaway perspective view of a lifting arm, both of FIG. 1.

The present invention is a wall lift 10 as shown in FIGS. 1–16. The wall lift 10 has four integral main components. The four main components are a base 12, lifting arm 14, wall attachment bracket 16 and one or more safety straps 18. Each main component includes its own individual components which aid in the operation of the wall lift 10. The following is a discussion of each main component of the wall lift 10 and a method of lifting a wall with the wall lift 10.

As shown in FIGS. 1, 2,6, 9, and 10, the base 12 includes a floor plate 20, a vertical U-channel 22 extending upward from the floor plate 20, and a support gusset 24 attached between the floor plate 20 and the vertical U-channel 22. The floor plate 20 includes four holes 26 to receive duplex nails 28. The vertical U-channel 22 has a rear face 30, two sides 32 and an open face 34. Two ears 36 extend outward from the sides 32, where the sides 32 meet the rear face 30 at the top 38 of the vertical U-channel 22. The ears 36 each have a retaining hole 40 for receiving a hook 41 of a retaining strap 42. The sides 32 of the vertical U-channel 22 each have an angled slot 44 near the bottom 46 of the U-channel 22.

Figure 3:
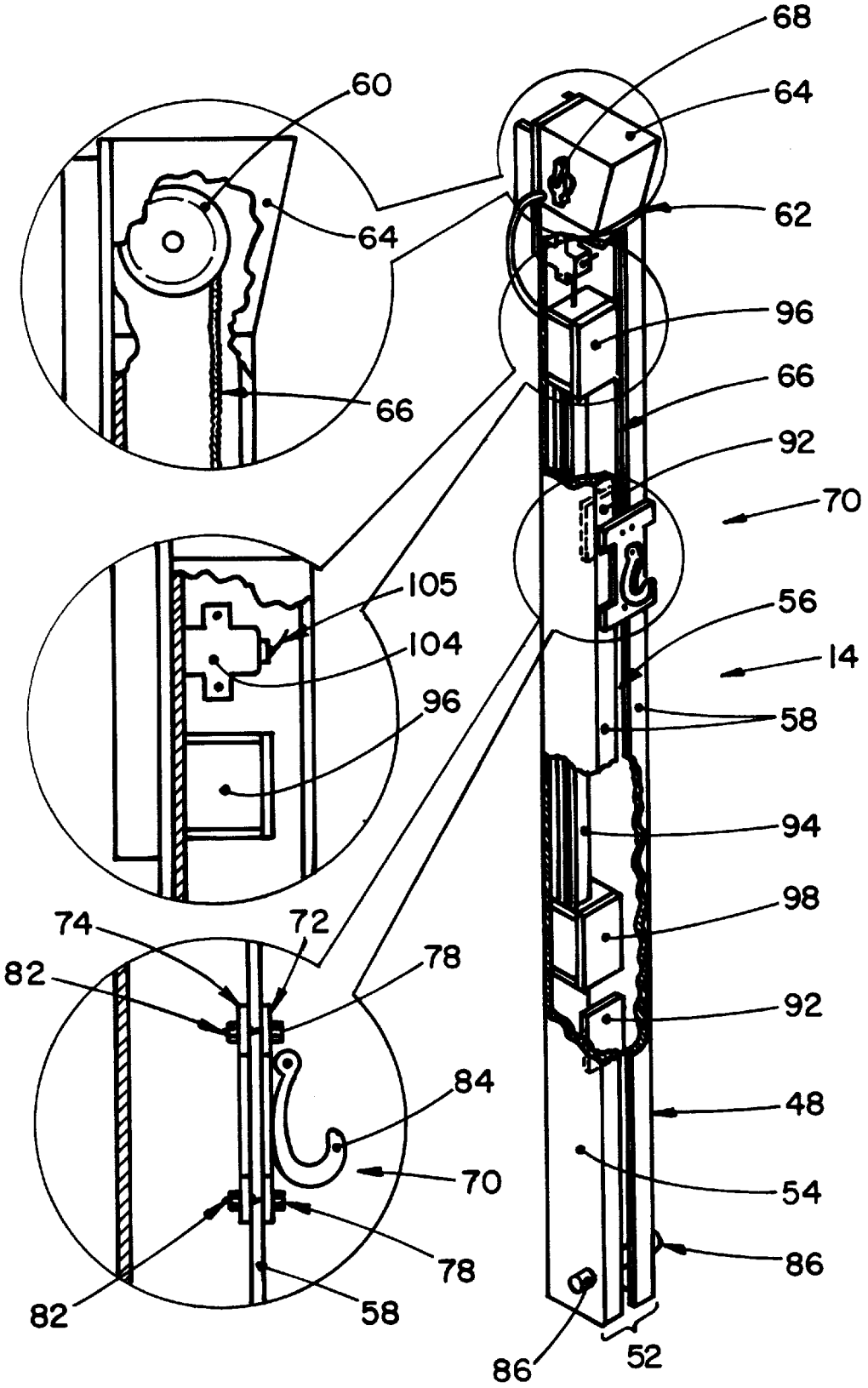
FIG. 3 is a perspective cutaway view of the lifting arm of FIG. 1.
Figure 4:
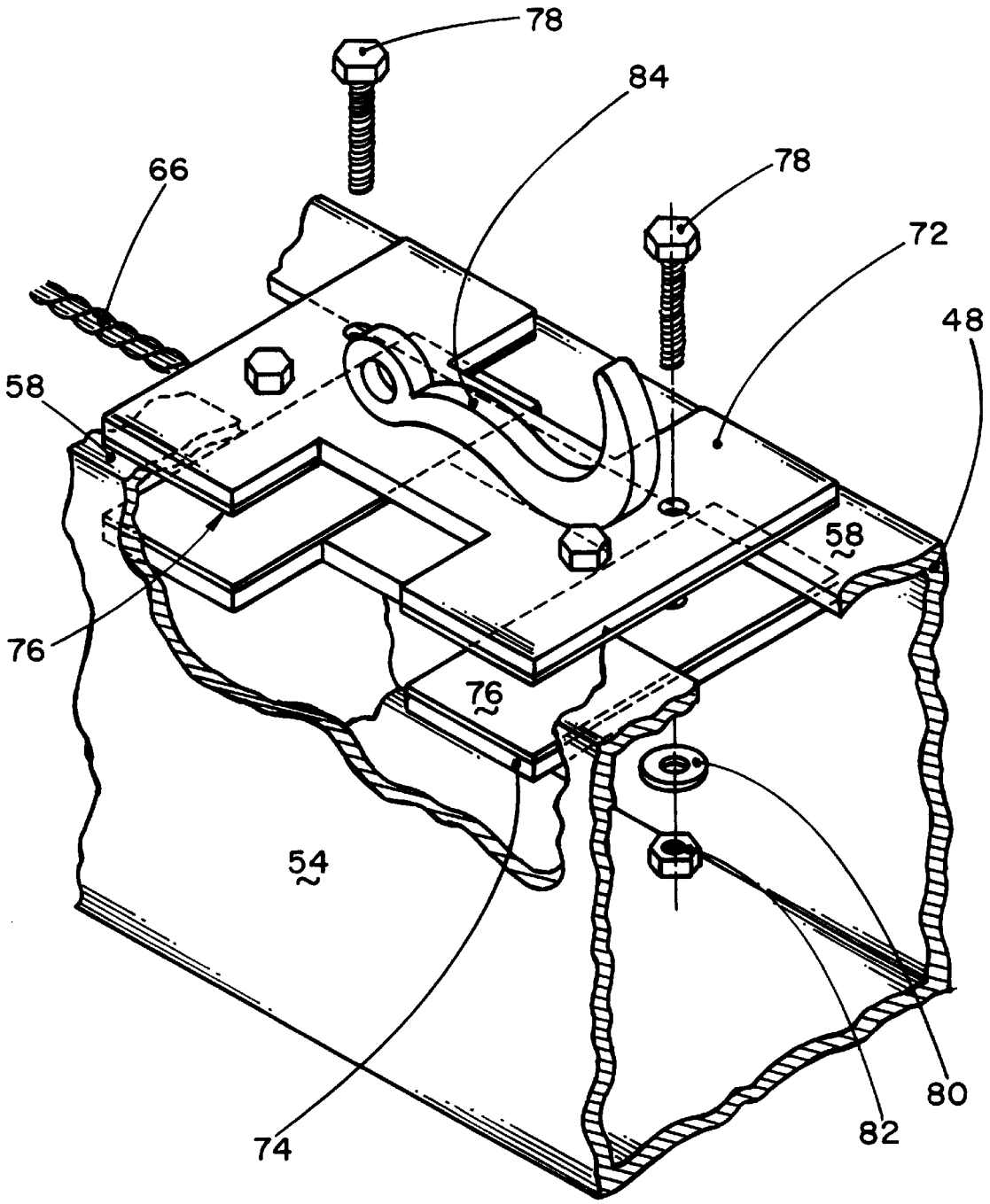
FIG. 4 is a perspective cutaway view of the lifting arm with a wall movement unit, both of FIG. 1.

As shown in FIGS. 1–4, the lifting arm 14 is an elongated rectangular shaped tube 48 having a rear face 50, a front face 52 and two sides 54. The front face 52 includes a continuous lengthwise opening 56 along its center, thereby forming a track 58 on each side of the opening 56. An electric winch 60 is mounted at the top end 62 of the tube 48 and enclosed by a plastic cover 64, shown in FIG. 3. The winch 60 acts as a motorized cable movement system. The winch 60 is equipped with a cable 66 and free wheel lever 68. The free wheel lever 68 allows the cable 66 to be unwound from the winch 60. A wall movement unit 70 attaches to the cable 66 and is pulled along the tracks 58 of the tube 48 by the winch 60. The cable 66 is positioned inside the tube 48 to insure safe operation. As shown in FIG. 4, the wall movement unit 70 includes a front plate 72 and rear plate 74. Each plate 72, 74 includes a surface covering 76 where the plates 72, 74 contact the tracks 58. The surface covering 76 is a light plastic or any surface coating which will reduce friction and allow the unit 70 to slide up and down the tracks 58 freely. The two plates 72, 74 are sandwiched together by bolts 78, washers 80 and nuts 82. The bolts 78 and nuts 82 should not be over tighten to avoid binding of the unit 70 as it slides along the tube tracks 58. A hook 84 is mounted to the front plate 72, which extends outwards from the tube 48. The cable 66 is attached to the rear plate 74 (not shown) using any conventional means of fastening. Two ends 86 of a pin 88 extend outwardly from sides 54 of the tube 48 at the bottom end 90 of the tube 48. The pin 88 is fixed to the tube 48 by any conventional means of fastening. Cross-members 92 are mounted along the inside of the tube 48 and below the travel area of the cable 66 and wall movement unit 70. The cross-members 92 provide strength and retain the shape of the tube 48. A cover channel 94 runs from a control box 96 to a switch box 98. The control box 96 contains electronics for the winch 60. The switch box 98 contains electronics connected to an operational switch 100 that is mounted on the side 54 of the tube 48. The cover channel 94 contains and protects wiring (not shown) between the control box 96 and switch box 98. Also, a remote switch box 102 can be wired directly to the winch 60. FIG. 3 illustrates a limit or trip switch 104 is mounted near the top 62 of the tube 48. The limit switch 104 is tripped by the wall movement unit 70 when the unit 70 reaches the top 62 of the tube 48. Once the unit 70 contacts the lever 105 of the limit switch 104, the limit switch 104 shuts down the winch 60.

Figure 5:
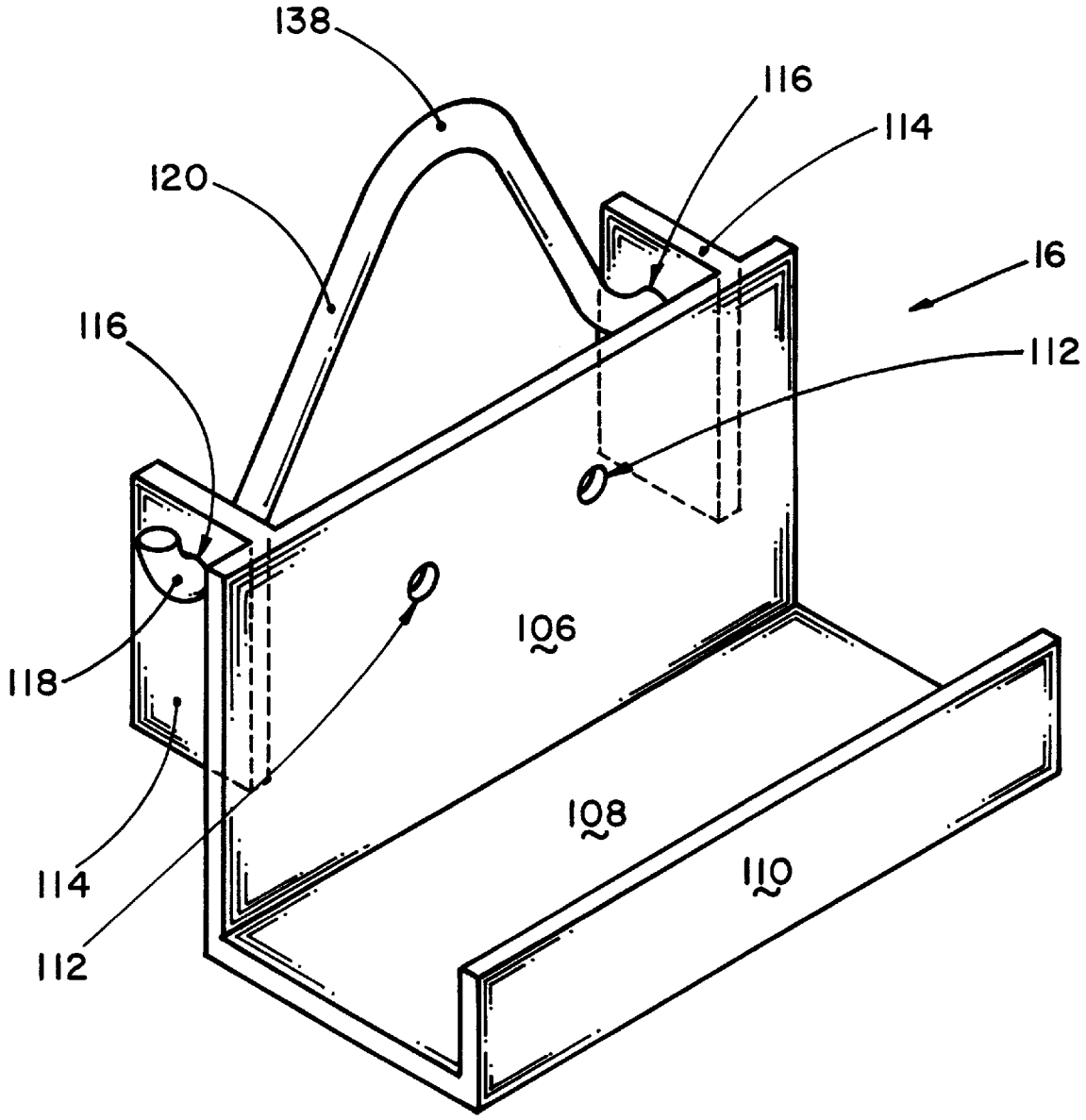
FIG. 5 is a perspective view of a wall attachment bracket of FIG. 1.
Figure 6:
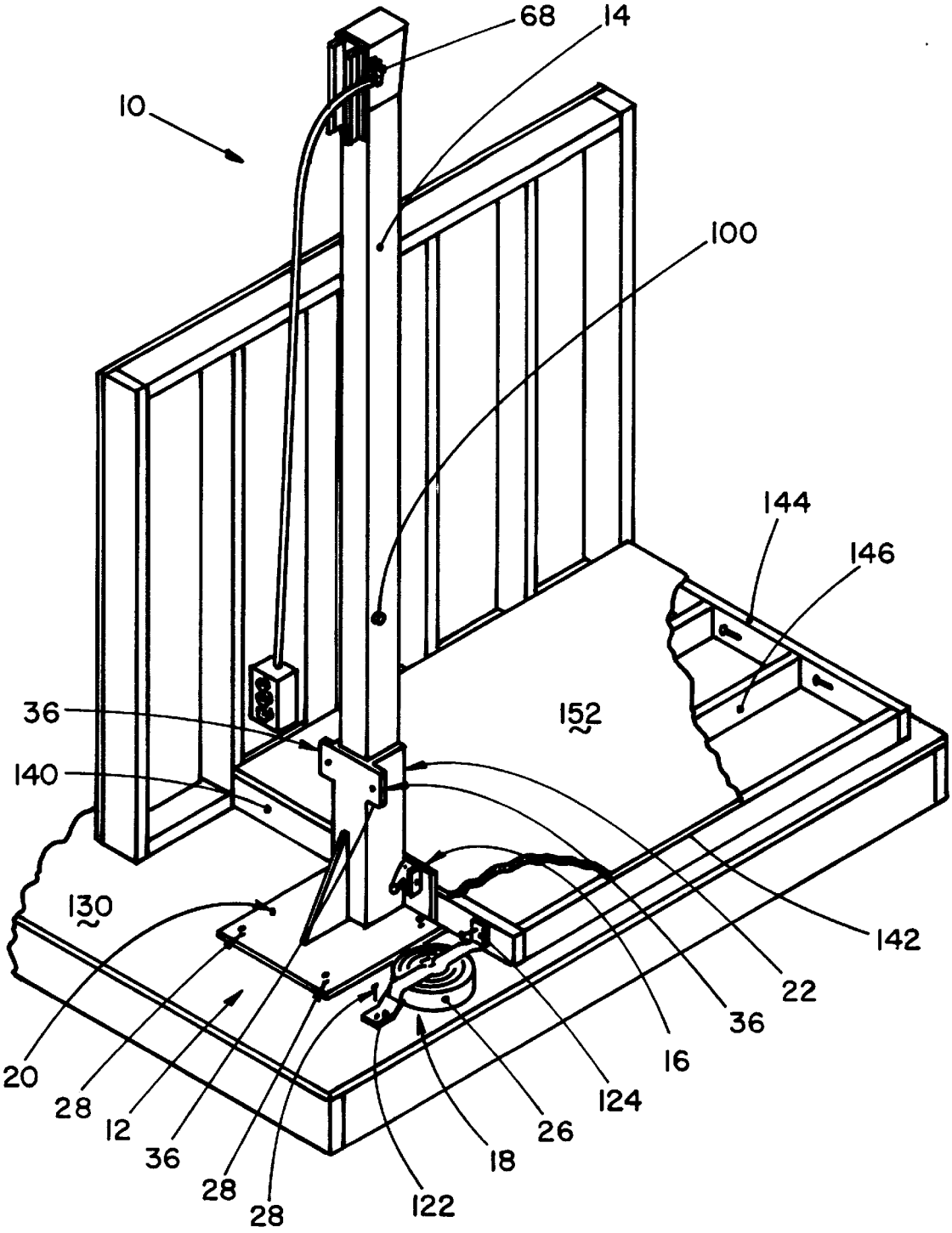
FIG. 6 is a perspective view of the wall lift of FIG. 1 and a wall.
Figure 7:
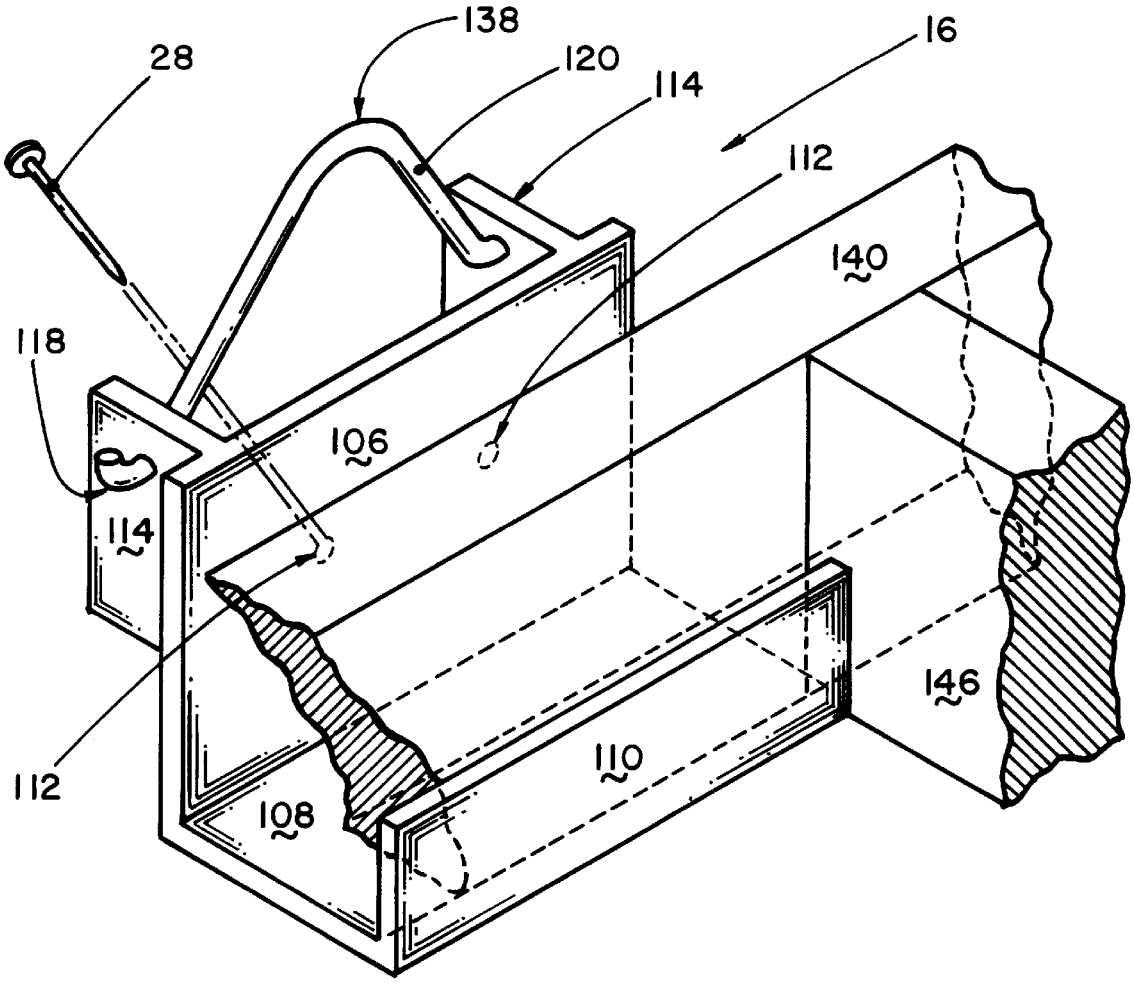
FIG. 7 is a perspective view of the wall attachment bracket attached to a top of the wall of FIG. 6.

As shown in FIGS. 5 and 7, the wall attachment bracket 16 includes a rear plate 106, a bottom plate 108 and a front edge plate 110, which can be formed from one piece of material. The rear plate 106 includes two nail holes 112 and two hanger ears 114 extending rearwardly from the rear plate 106. The hanger ears 114 includes holes 116 to receive ends 118 of a hanger 120. As shown in FIGS. 1, 6, 9 and 10, the safety strap 18 includes a floor tab 122, wall tab 124 and a strap 126 between the tabs 122, 124. Each tab 122, 124 includes a hole 128 to receive a nail 28 and the floor tab 122 includes a forty-five (45) degree bend. The strap 126 is usually made of a high strength flexible woven nylon.

Figure 9:
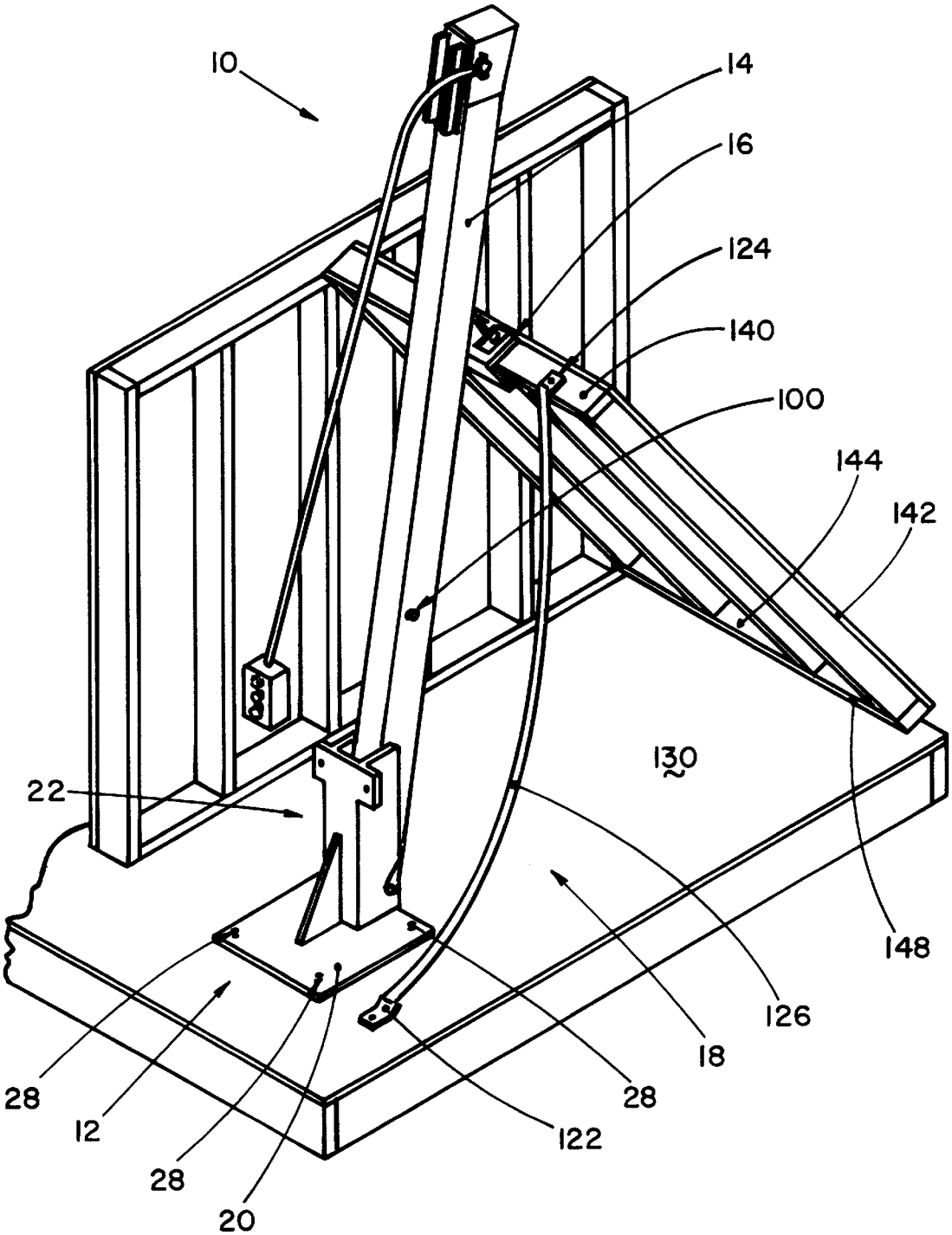
FIG. 9 is a perspective view of the wall lift lifting the wall of FIG. 5.
Figure 10:
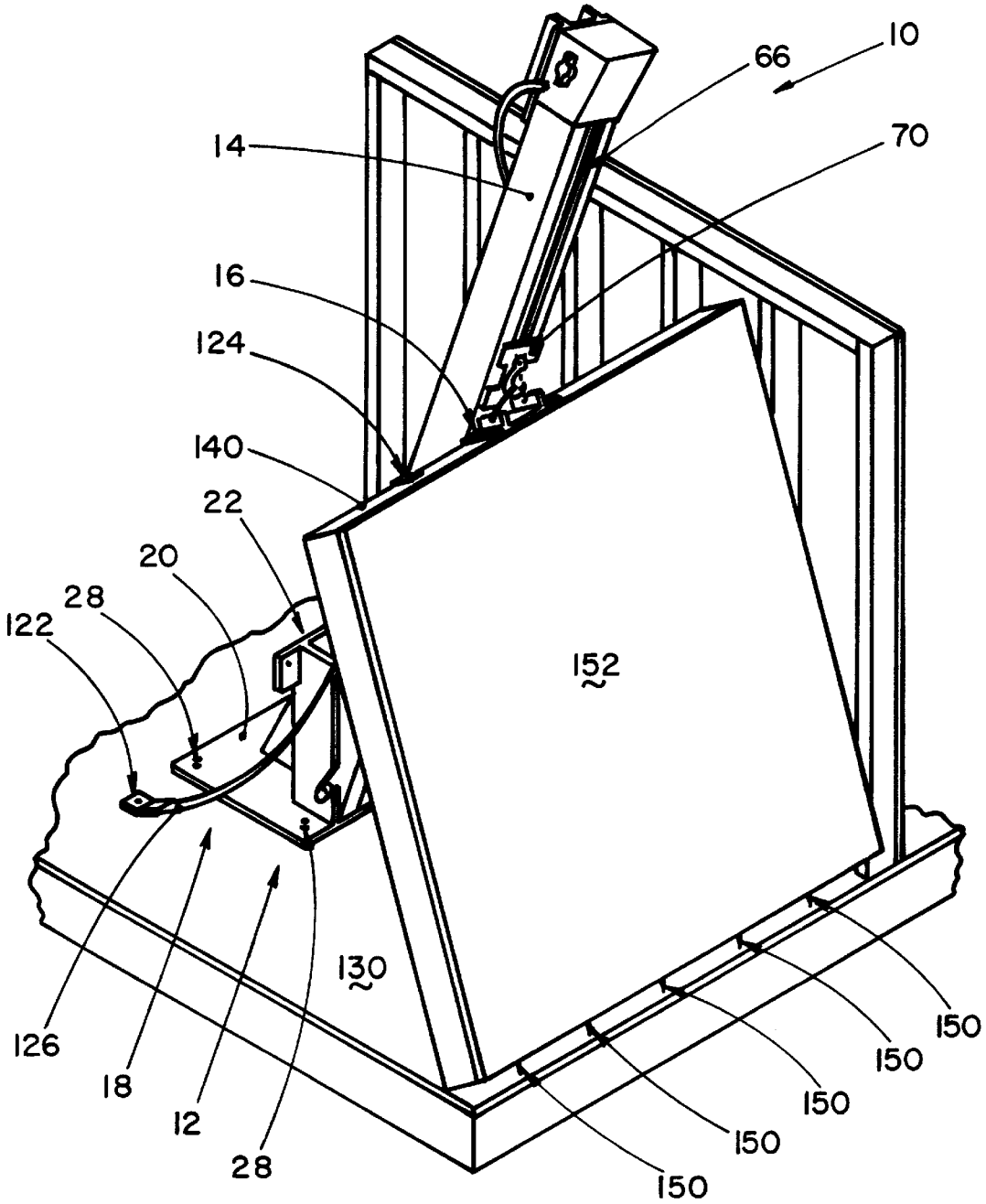
FIG. 10 is another perspective view of the wall lift lifting the wall of FIG. 5.

The following describes the interaction and positioning of the main components. As shown in FIGS. 6, 9 and 10, the base 12 is secured to the subfloor 130 with four duplex nails 28 through floor plate holes 26. The duplex nails 28 are recommended throughout this description, because they allow quick and easy removal with hammer claw or crowbar. The U-channel 22 of the base 12 acts as a lifting arm receiver, which receives and retains the lifting arm 14 in an upright position, until the winch 60 is activated. The ends 86 of the pin 88 that extend from the lifting arm tube 48 engage the slots 44 of the U-channel 22, when the lifting arm tube 48 is inserted into the U-channel 22. Once inserted, the pin ends 86 are supported by and rotate about the bottom 132 of the slots 44. The hooks 41 of the retaining strap 42 are inserted into the retaining holes 40 of the U-channel ears 36 to retain the lifting arm 14 in the upright position, until use. The top 138 of the hanger 120 slips over and is retained by the hook 84 of the wall movement unit 70. Various safety devices (not shown) connected to the hook 84 can be employed to prevent the hanger 120 from slipping off the hook 84, during wall lift 10 operation. The wall attachment bracket 16 wraps around the top plate 140 of the wall 142 as shown in FIGS. 6, 7, 9 and 10. The floor tab 122 is nailed to subfloor 130 using a duplex nail 28. The end of the floor tab 122 that is bent extends in an upward direction towards the wall 142 to be lifted. The wall tab 124 is nailed with a duplex nail 28 to the top plate 140 of the wall 142.

Figure 8:
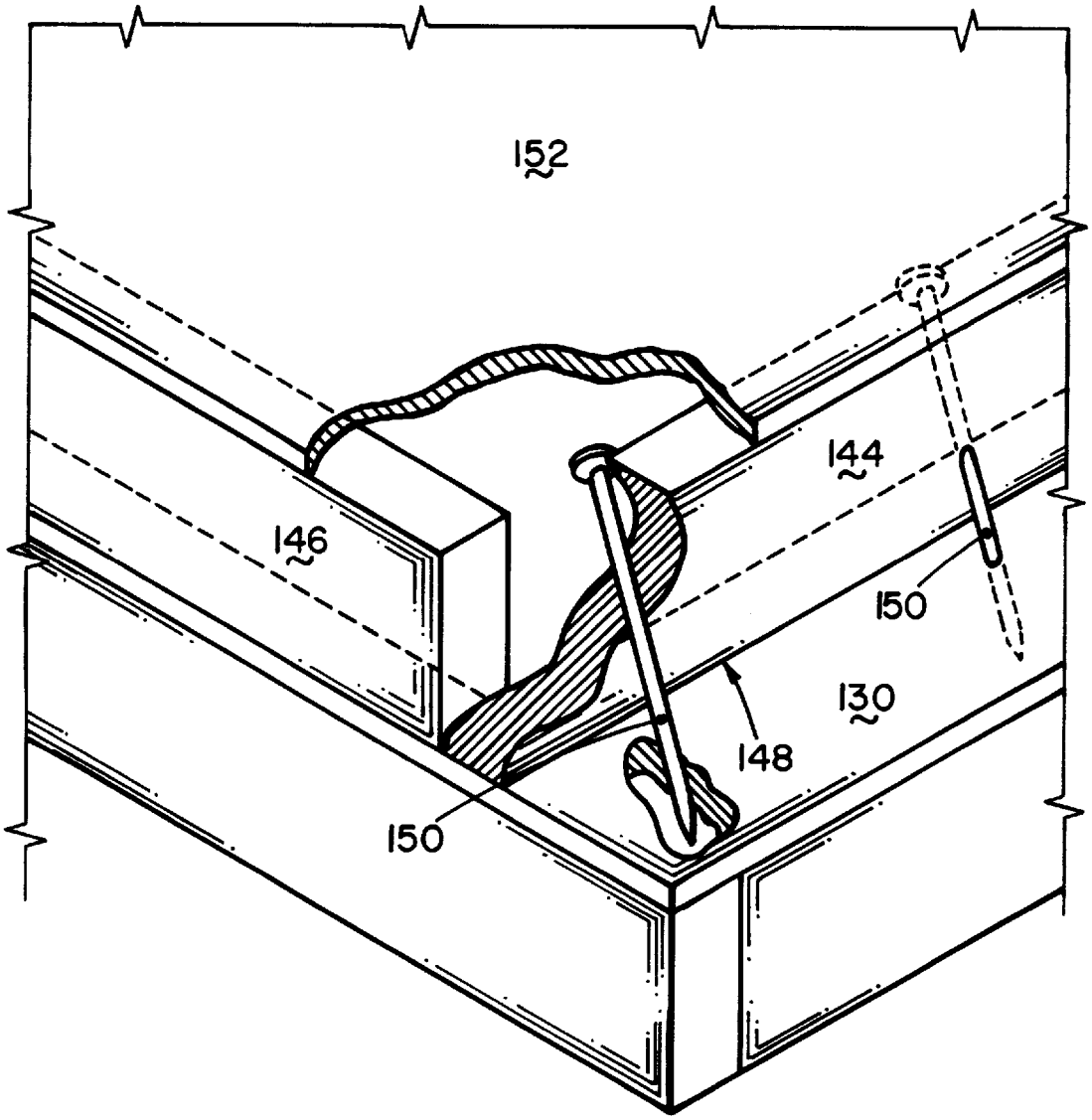
FIG. 8 is a perspective cutaway view of a bottom of the wall of FIG. 5.

A method of lifting the wall 142 using the wall lift 10 is as follows. First, the wall 142 is built by assembling the top plate 140, bottom plate 144 and studs 146. During fabrication of the wall 142, the bottom plate 144 is positioned on the subfloor 130 so that edge 148 of the bottom plate 144 is the point of rotation of the wall 142 when it is lifted. The edge 148 should be aligned along its final position on the subfloor 130. To secure the bottom plate 144 in position during rotation, the bottom plate 144 is nailed as shown in FIGS. 6, 8 and 10. As the wall 142 is rotated upwards the nails 150 bend while holding the edge 148 in position. Once the wall 142 is upright and secured, the bent nails 150 are removed. After the bottom plate 144 is nailed, the exterior surface 152 is applied. One or more safety straps 18 are attached to the subfloor 130 and the wall 142, as described above. As shown in FIGS. 9 and 10, the safety strap 18 restricts the wall 142 from tipping outward after the wall 142 has been lifted into an upright position. The combination of the safety straps 18 and the wall lift 10 holds the wall 142 in place until the wall 142 is permanently secured.

The wall attachment bracket 16 is placed about the top plate 140 at the center of the wall 142 as shown in FIGS. 6, 9 and 10. If desired, the wall attachment bracket 16 can be nailed to the top plate 140 using nails 28 through holes 112. Next, the base 12 is secured near the top plate 140 with nails 28. Positioning of the base 12 should allow the hook 84 of the lifting arm 14 to be close enough to engage the hanger top 138 of the wall attachment bracket 16. The lifting arm 14 is then placed into the U-channel 22 as described above. Before placing the lifting arm 14 in the U-channel 22, the free wheel lever 68 of the winch 60 should be positioned to allow the cable 66 to be released and the wall movement unit 70 moved to the bottom end 90 of the tube 48. After moving the wall movement unit 70, the free wheel lever 68 should be positioned to allow the cable 66 to be retracted by the winch 60. As mentioned, the retaining strap 42 is used to retain the lifting arm 14 in an upright position, until use.

Next, the wall attachment bracket 16 is attached to the hook 84 and the retaining strap 42 can be removed. The winch 60 is then activated using the switch 100 or remote switch box 102. Activation of the winch 60 retracts the cable 66, thereby raising the wall movement unit 70 along the tracks 58 toward the top 62 of the tube 48. As the wall 142 is lifted, the lifting arm 14 rotates forward about the pin ends 86, from a vertical position towards a horizontal position. This allows the wall 142 to rotate about the edge 148 of the bottom plate 144. The winch 60 automatically shuts off when the wall movement unit 70 strikes the limit switch lever 105. Another means of stopping the winch 60 would be manually using a stop switch 156 connected to the winch 60, as shown on the remote switch box 102 in FIG. 1. Once the wall 142 is in an upright position, the wall 142 can be secured to the subfloor 130 and the bent nails 150 can be removed from the bottom plate 144.

Figure 11:
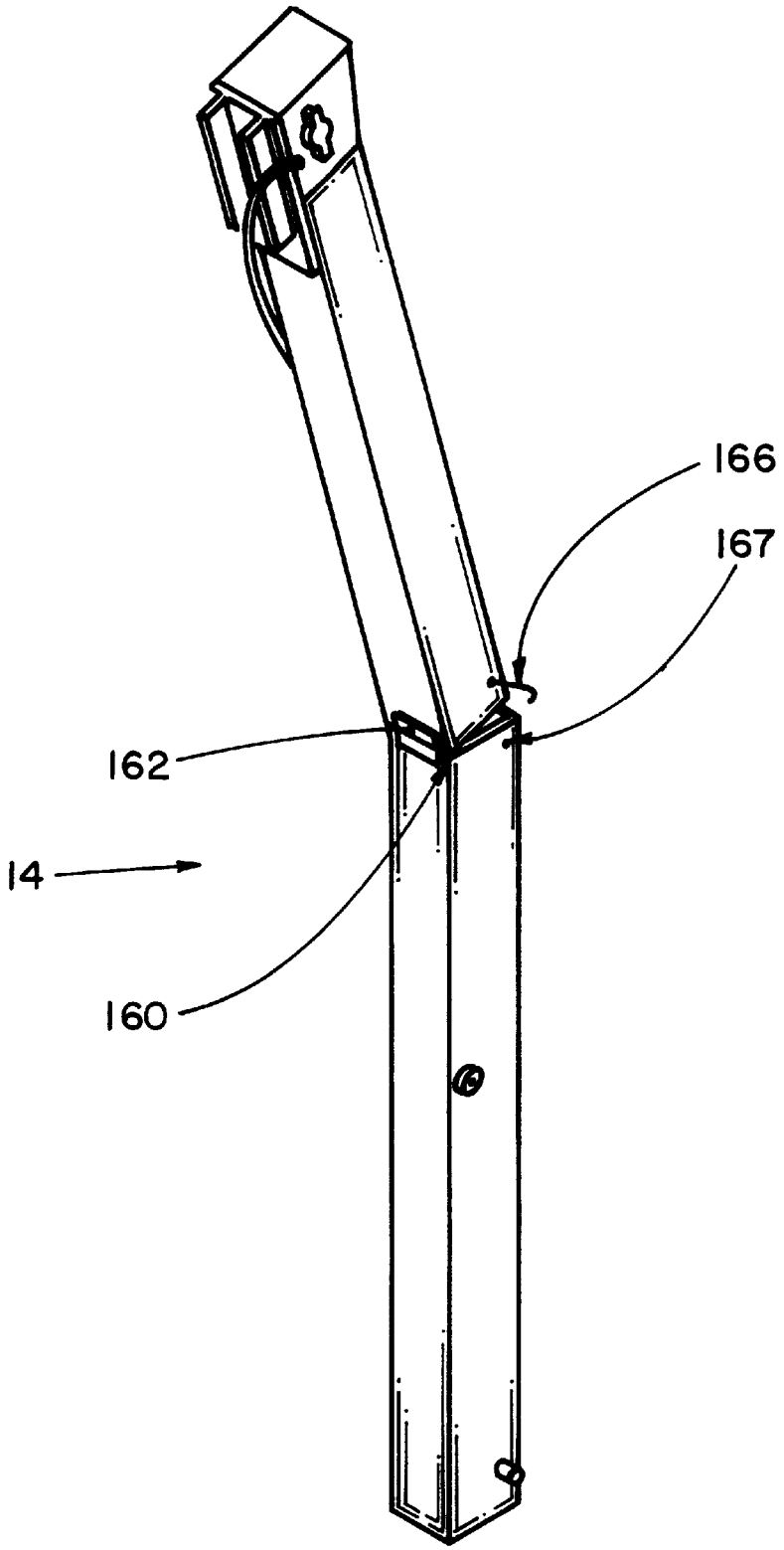
FIG. 11 is a perspective view of a folding feature of the lifting arm of FIG. 1.
Figure 12:
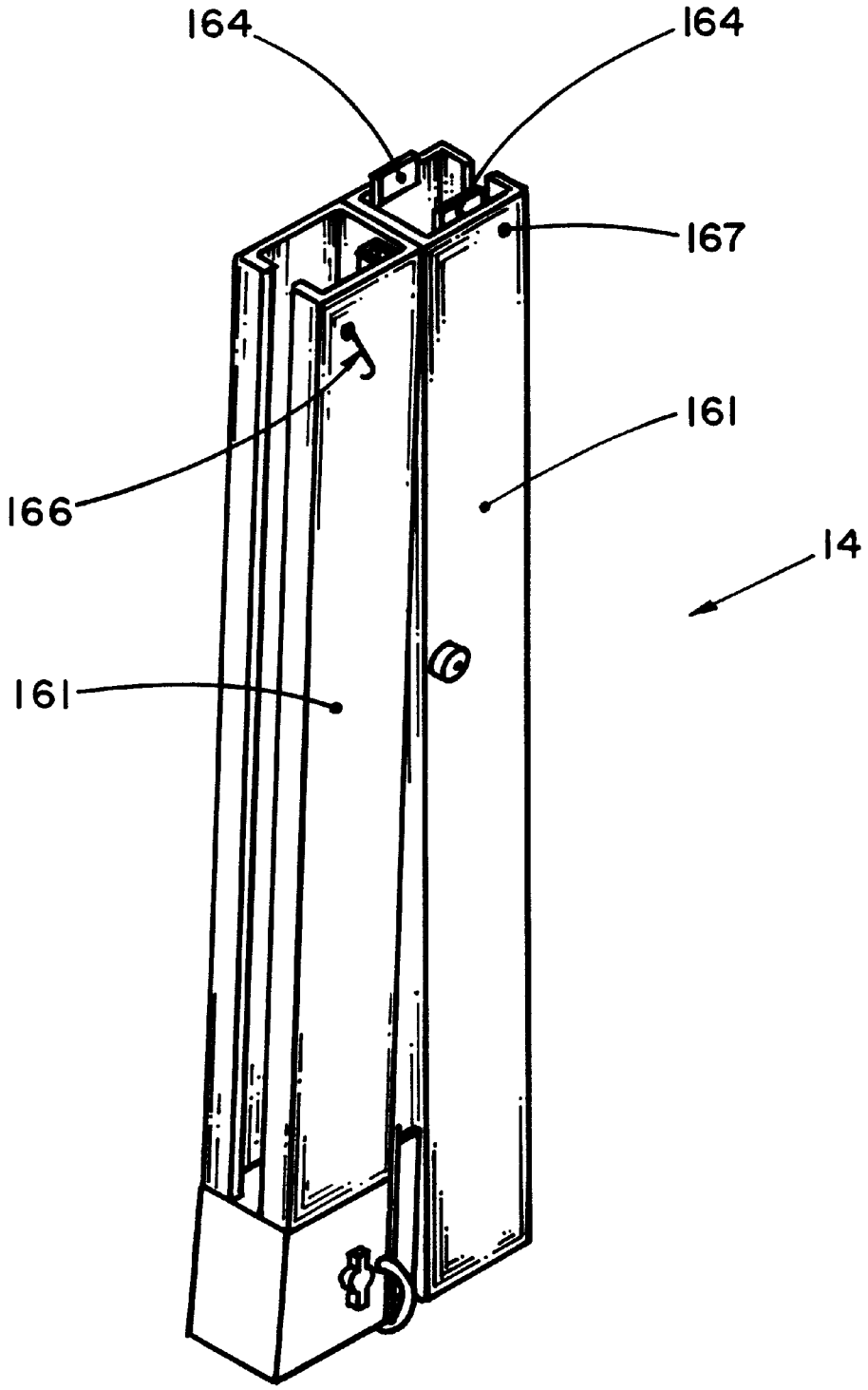
FIG. 12 is another perspective view of the folding feature of the lifting arm of FIG. 11.
Figure 13:
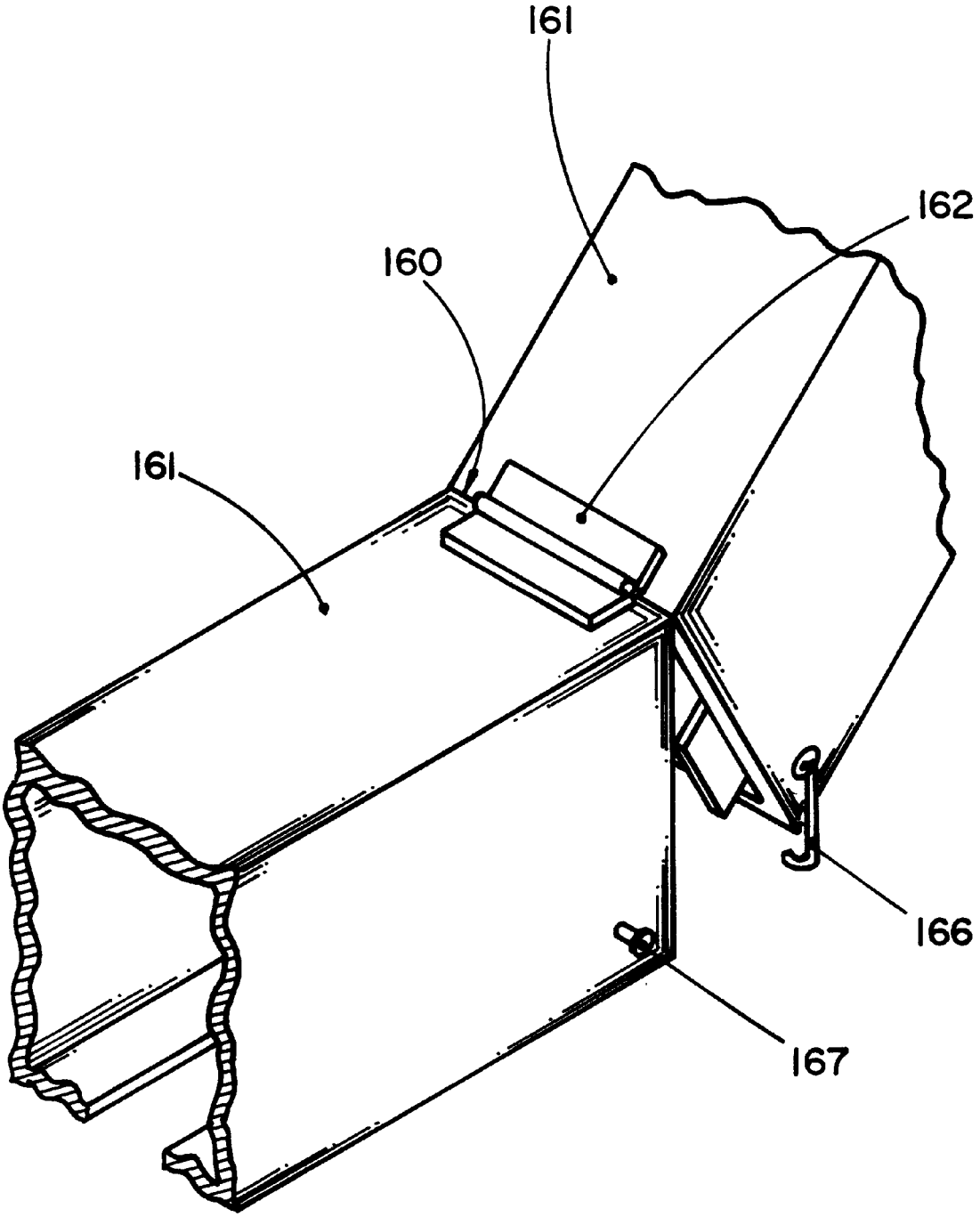
FIG. 13 is a perspective view of a feature to maintain the lifting arm of FIG. 11 in an unfolded position.
Figure 14:
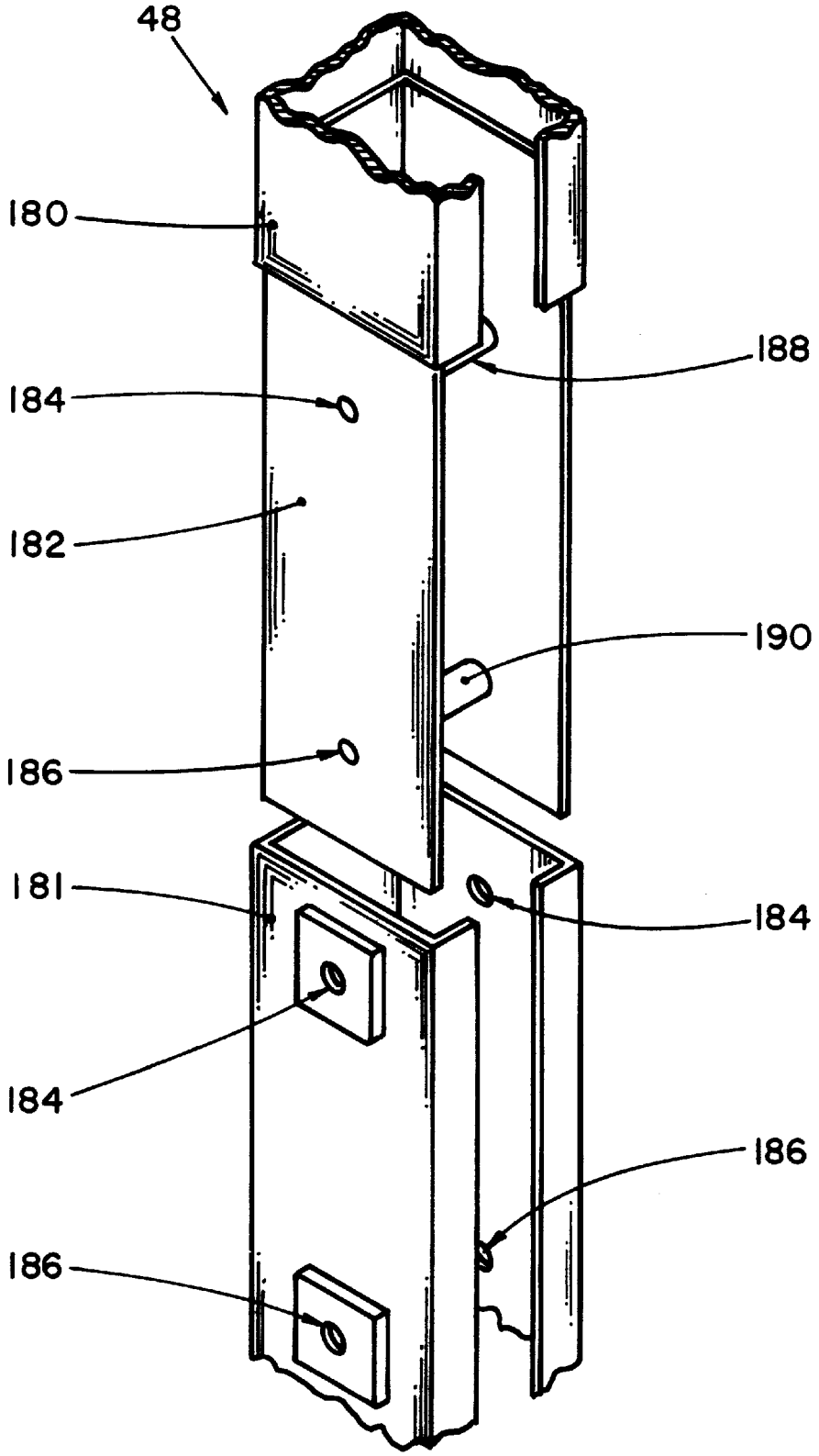
FIG. 14 is a perspective view of a breakdown feature of the lifting arm of FIG. 1 unassembled.
Figure 15:
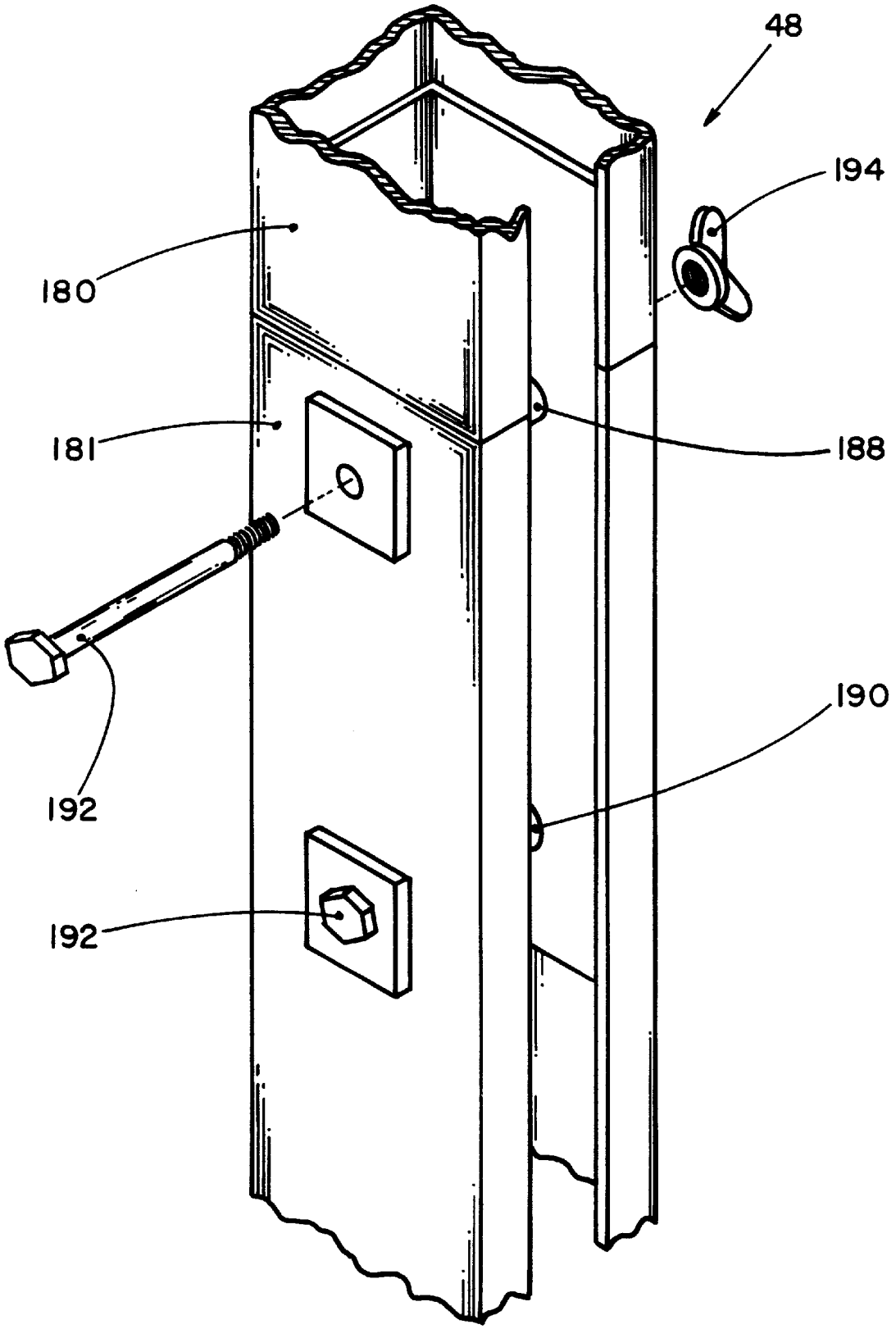
FIG. 15 is a perspective view of the breakdown feature of the lifting arm of FIG. 14 assembled.

FIGS. 11–15 show two different alternatives to break down the wall lift 10 into a smaller size for transport. FIGS. 11–13 illustrate the wall lift 10 with a folding feature. The lifting arm tube 48 folds into two sections 161 at its lengthwise midpoint 160 about a hinge 162. Extension tabs 164 are used to aligned the sections 161 of the tube 48 and provide support when the tube 48 is unfolded. A latch 166 and catch 167 is employed to maintain the tube 48 in an unfolded position. FIGS. 14–15 show another alternative of breaking down the wall lift 10. The lifting arm tube 48 separates into two sections 180 and 181 at about the midpoint of the tube 48. Section 180 includes extension 182. The extension 182 is of a U-channel shape and includes holes 184 and 186. Holes 184 are aligned and connected by hollow shaft 188. Holes 186 are aligned and connected by hollow shaft 190. The extension 182 has dimensions slightly smaller than the lifting arm tube 48 to allow the extension 182 to fit inside section 181. Section 181 includes holes 184 and 186. The extension 182 is fitted into the section 181 so that the holes 184 of both sections 180, 181 align and the holes 186 of both sections 180, 181 align. Bolts 192 with wing nuts 194 are used to secure the sections 180 and 181 together. For the break down of the wall lift 10 in either case, the switch box 98 and switch 100 should be mounted in the section having the wench 60.

Figure 16:
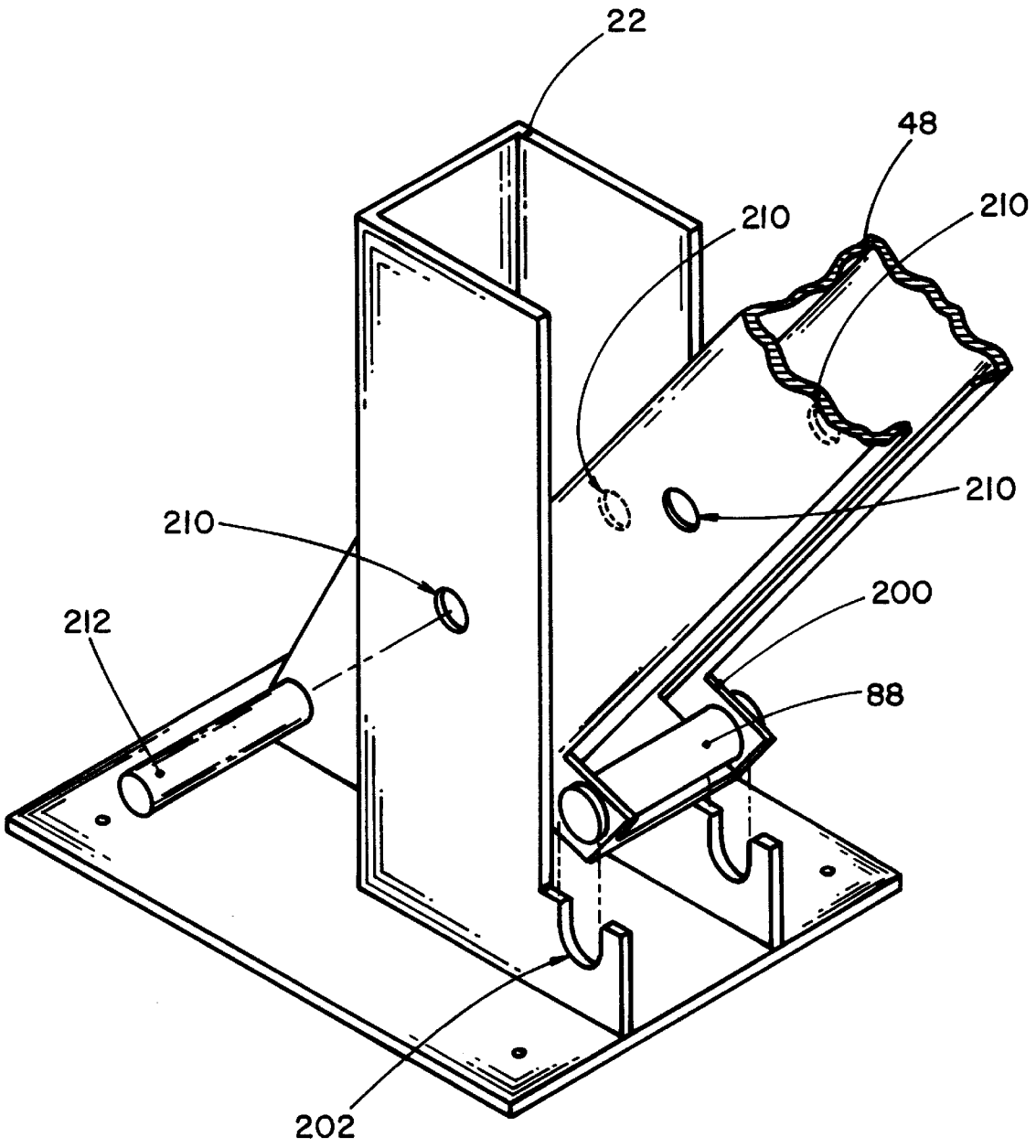
FIG. 16 is a perspective view of another embodiment of mounting the lifting arm of FIG. 1 to a base.

The wall lift 10 can be made out of many materials. In the case of a prototype, the base 12, lifting arm tube 48, and wall attachment bracket 16 were made of aluminum. The wall movement unit 70 and hanger 120 were made of steel. Materials chosen to fabricate the wall lift 10 should be as light as possible, while maintaining the strength required to lift the wall 142. It is envisioned that the length of the tube 48 could be adjustable to accommodate different size walls. The wench 60 could be of a type that operates with forward and reverse modes and having forward 170, reverse 172 and stop 156 controls as shown on the remote switch 102 of FIG. 1. FIG. 16 shows an alternative mounting system for the lifting arm tube 48. A leg 200 projects forward from the lifting arm tube 48 and includes the pin 88. The base 12 includes a catch 202 projecting upward from the base 12. The catch 202 receives the pin 88. The catch 202 and pin 88 combination allows the lifting arm tube 48 to rotate on the base 12 about pin 88. The U-channel 22 and lifting arm tube 48 both include holes 210 to receive a holding rod 212. The holding rod 212 replaces the retaining strap 42. When the holding rod 212 is in place, the lifting arm tube 48 is retained in place within the U-channel 22.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention which is to be given the full breadth of the appended claims and any and all equivalents thereof.

I claim:

1. A wall lift for lifting a wall in an upright position comprising:

a floor plate;

a lifting arm rotatably attached to said floor plate, said lifting arm including a top and bottom, whereby said bottom is rotatably attached to said floor plate;

said lifting arm being an elongated rectangular shaped tube including a rear face, a front face and two sides and said front face includes a continuous lengthwise opening along its center, thereby forming a track on each side of said opening;

a motorized cable movement system attached to said lifting arm;

a cable attached to said motorized cable movement system; and a wall movement unit including a front plate and rear plate for lifting said wall, said wall movement unit attached to said lifting arm by sandwiching said tracks and opening between said front and rear plates, said front and rear plates slidable against said tracks of said lifting arm, said wall movement unit connected to said cable for movement of said wall movement unit by said motorized cable movement system and thereby lifting of said wall.

2. The wall lift of claim 1, wherein said floor plate includes a lifting arm receiver extending upward from said floor plate for retaining said lifting arm.

3. The wall lift of claim 2, wherein said lifting arm is mounted in said lifting arm receiver such that said bottom of the lifting arm rotates in said lifting arm receiver so that the lifting arm may move between a horizontal and vertical position.

4. The wall lift of claim 2, wherein said lifting arm receiver includes an open side to allow movement of said lifting arm between said horizontal and vertical position.

5. The wall lift of claim 1, wherein said lifting arm includes a pin about which said lifting arm rotates; and wherein said floor plate includes a catch to retain said pin and allow rotation of said lifting arm about said pin.

6. The wall lift of claim 1, wherein said motorized cable movement system retracts said cable and moves said wall movement unit along said lifting arm.

7. The wall lift of claim 1, wherein said motorized cable movement system is attached to said top of said lifting arm.

8. The wall lift of claim 1, wherein said motorized cable movement system is a winch.

9. The wall lift of claim 1, wherein said wall movement unit includes a hook mounted to said front plate.

10. The wall lift of claim 1, wherein said wall movement unit further includes a wall attachment bracket for attachment to said top of said wall, whereby said wall attachment bracket also connects to said wall movement unit.

11. The wall lift of claim 10, wherein said wall attachment bracket includes a rear plate, a bottom plate extending outwardly from a bottom of said rear plate, and a front edge plate extending upward from said bottom plate and wherein said rear plate includes a hanger to be connected to a hook on said wall movement unit.

12. The wall lift of claim 2, further including at least one receiver rod hole in said lifting arm receiver; at least one lifting arm rod hole in said lifting arm which aligns with said receiver rod hole; and a rod which inserts into said receiver rod and lifting arm holes to retain said lifting arm from moving from a vertical position to a horizontal position.

13. The wall lift of claim 1, wherein said tube of said lifting arm separates into two sections and wherein said two sections are hinged together.

14. The wall lift of claim 1, wherein said tube of said lifting arm separates into a first and second section.

15. The wall lift of claim 14, wherein said first section includes an extension which fits into said second section.

16. The wall lift of claim 15, wherein said extension includes at least one set of aligned extension bolt holes and said second section includes at least one set of aligned second section bolt holes which align with said extension bolt holes when said extension is inserted into said second section.

17. A wall lift for lifting a wall in an upright position comprising:

a floor plate;

a lifting arm receiver extending upward from said floor plate;

a lifting arm rotatably attached to said lifting arm receiver, said lifting arm including a top and bottom;

a pin at said bottom of said lifting arm about which said lifting arm rotates in said lifting arm receiver and wherein said lifting arm receiver includes at least one slot having an open end and a closed end and wherein said open end receives said pin and said closed end of said slot supports said pin;

a motorized cable movement system attached to said lifting arm;

a cable attached to said motorized cable movement system; and a wall movement unit for attachment to a top of said wall, said wall movement unit attached to and slidable along said lifting arm, said wall movement unit connected to said cable for movement of said wall movement unit by said motorized cable movement system and thereby lifting of said wall.

18. The wall lift of claim 17, wherein said lifting arm is an elongated rectangular shaped tube including a rear face, a front face and two sides and wherein said front face includes a continuous lengthwise opening along its center, thereby forming a track on each side of said opening.

19. The wall lift of claim 17, wherein said wall movement unit includes a front plate and rear plate sandwiched together and wherein said tracks are between said front and rear plate, such that said wall movement unit slides along said tracks.

20. A method of lifting a prefabricated wall comprising:

a. lifting a top of the wall so that the wall rotates about a bottom of the wall using a wall lift, said wall lift including a floor plate;

a lifting arm rotatable attached to said floor plate, said lifting arm including a top and bottom, whereby said bottom is rotatable attached to said floor plate;

said lifting arm being an elongated rectangular shaped tube including a rear face, a front face and two sides and said front face includes a continuous lengthwise opening along its center, thereby forming a track on each side of said opening;

a motorized cable movement system attached to said lifting arm;

a cable attached to said motorized cable movement system;

a wall movement unit including a front plate and rear plate for lifting said wall, said wall movement unit attached to said lifting arm by sandwiching said tracks and opening between said front and rear plates, said front and rear plates slidable against said tracks of said lifting arm, said wall movement unit connected to said cable for movement of said wall movement unit by said motorized cable movement system and thereby lifting of said wall;

b. using a lifting arm rotatably attached to a surface near the wall, said lifting arm including a motor and starting in a vertical position, said motor including a cable attached to a wall movement unit, and said wall movement unit attached to the top of said wall and also slidably attached to the lifting arm;

c. allowing said lifting arm to rotate in the direction that the wall is being lifted as the motor retracts the cable;

d. retracting the cable with said motor and pulling the wall movement unit towards a top of the lifting arm; and e. lifting the wall due to attachment of the wall movement unit to the top of the wall.

* * * * *